United States Patent [19]

Mazzini

[11] 4,045,979

[45] Sept. 6, 1977

[54] ICE-MAKING MACHINE

[75] Inventor: Leone Mazzini, Cremona, Italy

[73] Assignee: Castel Mac S.p.A., Castelfranco Veneto, Italy

[21] Appl. No.: 636,116

[22] Filed: Nov. 28, 1975

[51] Int. Cl.[2] ..... F25C 5/08

[52] U.S. Cl. ..... 62/352; 62/348

[58] Field of Search ..... 62/340, 348, 352

[56] References Cited

U.S. PATENT DOCUMENTS

| | | | |
|---|---|---|---|
| 2,747,375 | 5/1956 | Pichler | 62/348 |
| 3,027,731 | 4/1962 | Lindenberg et al. | 62/352 |
| 3,045,442 | 7/1962 | Durham et al. | 62/352 |
| 3,277,661 | 10/1966 | Dwyer | 62/352 |
| 3,380,261 | 4/1968 | Hendrix et al. | 62/352 |
| 3,654,771 | 4/1972 | Kuebler | 62/352 |

*Primary Examiner*—William E. Wayner
*Assistant Examiner*—Robert J. Charvat

[57] ABSTRACT

In an ice-making machine comprising an array of freezing members dipped in a tiltable ice-forming tray, the combination of an ice-cube deflecting and lifting baffle, concurrently tiltable with the tray, and a partition wall in the interior of the tub to collect unfrozen water, said partition wall defining a water-collecting chamber wherefrom the water can be discharged through a specially provided channel.

3 Claims, 3 Drawing Figures

ICE-MAKING MACHINE

This invention relates to an ice-making machine and more particularly to a device for separating ice from water in such a machine.

Machines of this kind comprise, in general, a cooling circuit connected to freezing elements immersed in a water-containing tub. Due to the action of cold, ice cubes are formed around such elements, the cube size being defined by the action of a control for stopping the freezing process. On completion of the formation of the ice cubes, the tub is tilted towards an inclined position by a specially provided actuating device about a shaft which has been installed in the vicinity of one of its edges. The ice cubes, as the freezing action is over, are unstuck and fall into an underlying reservoir, the latter also receiving the water dumped as the tub has been tilted.

It should be noted that the obtention of ice cubes along with water involves a considerable problem as to the storage and transportation of the ice cubes. Inasmuch as it is imperative to provide within the shortest possible delay a hermetic insulation of the cubes so as to prevent ice thawing, it should be provided to separate the cubes from the water held in the reservoir.

It has also been suggested to equip the reservoir with a grid arranged therein and intended to separate ice from water and by such an expedient a fairly satisfactory separation is achieved.

Both the grid as such and the water-collecting device are bulky and considerably reduce the effective volume of the ice reservoir while concurrently increasing both the cost and the intricacy of manufacture.

An object of the invention is to redress the above indicated defects by suggesting a separation of water from ice as carried out before collecting and storing the ice. A further object is to provide a separation device which has the least influence on the features of the reservoir.

Such an object is achieved according to the invention by a device mounted in a machine of the kind referred to above, which comprises a baffle for the ice cubes or slugs, arranged between the tub bottom and the freezing elements and adapted to deflect the ice into the underlying reservoir, and a water-collector, arranged in correspondence with the free wall of the tub, away of the wall on which the tilting shaft is mounted. The collector is a channel running along the free wall aforesaid and is open at a side and, in correspondence with and beneath which a water manifold is provided in the reservoir.

The collecting channel can be formed by a partition wall the distance of which from the free wall is less than the minimum dimension of the cubes and having a height less than that of the tub walls. The partition wall completes with the parallel free wall a channel which is capable of collecting the water which overflows over the partition wall as the tub is tilted, and is equipped with an opening, in correspondence with one of the end walls which are perpendicular to the partition wall and thus also to the tilting axis of the tub, and, through said opening, the water entering the channel is dumped into the underlying water manifold, the latter being provided, for example, in correspondence with a homologous wall of the reservoir.

By so doing, the separation of ice from water takes place already in the tub and the necessity of a bulky separation grid is thus done away with.

With reference to the drawings which accompany this specification the invention will be further explained in connection with an exemplary and nonlimiting embodiment thereof.

In the drawings:

In FIGS. 1 to 3 there is shown an evaporator 1 of an ice-making machine, the refrigeration circuit is not shown in detail as it is conventional.

Figure 1:
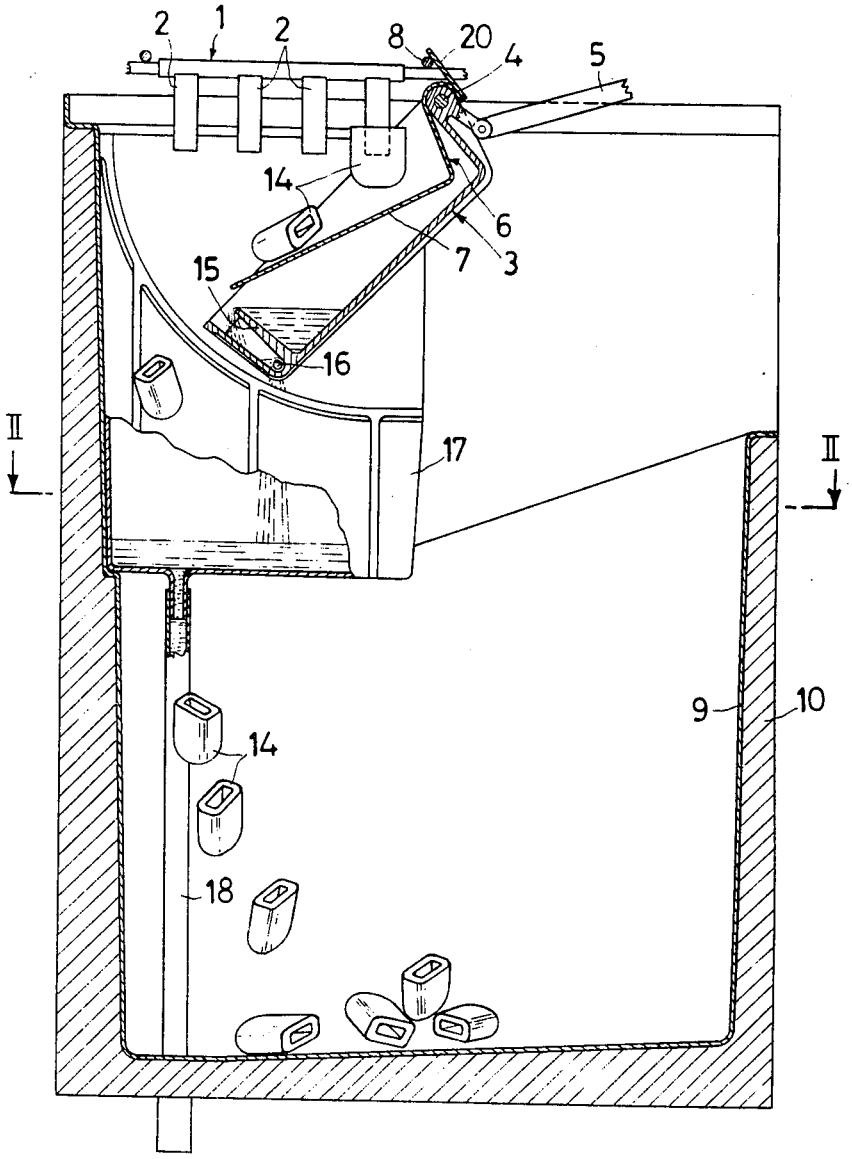
FIG. 1 is a cross-sectional view, giving a partial showing of an ice-making machine.
Figure 2:
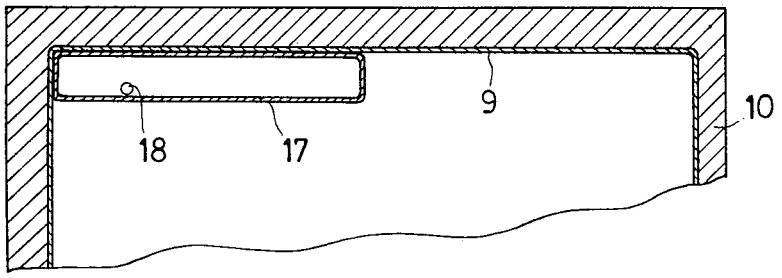
FIG. 2 is a cross-sectional view taken along the line II—II of FIG. 1.

From the bottom wall of the evaporator 1 project the freezing elements 2, having the appearance of rectangular feet or projections. These projections are immersed in a tub 3, which is filled by conventional means with water up to a preselected level. The tub is supported by one of its walls on a shaft 4 so as to be tiltable thereabout the shaft being fastened to the stationary structure of the machine. The tub 3 is normally held in its horizontal position (FIG. 3) by a positioning member 5. which is operable in a conventional manner selectively to tilt tub 3 between its two different positions as illustrated in FIGS. 1 and 3, respectively Pivotally mounted along one edge thereof on said one wall of the tub 3 so as to be pivotal therewith about the same shaft 4 is a baffle 6, which has a planar section 7 extending between the elements 2 and the bottom of the tub 3.

Figure 3:
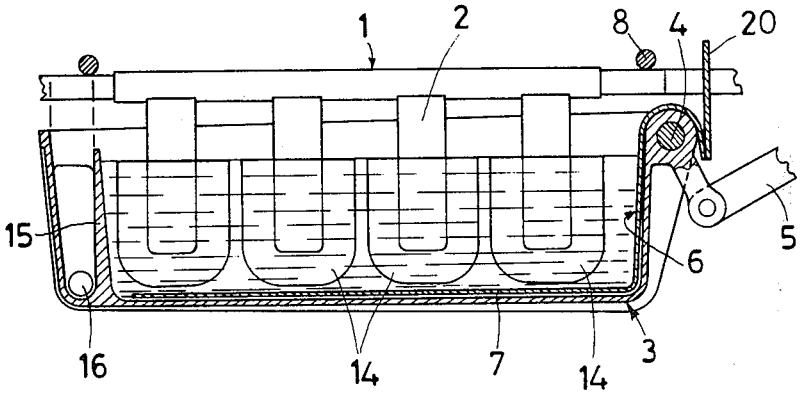
FIG. 3 is a close-up cross-sectional view of the tub of FIG. 1 in the horizontal position.

The member 5 can properly be actuated for example by a motor-driven cam, or the like, so as to enable the tub 3 to be tilted from the position of FIG. 3 to the position shown in FIG. 1. The baffle 6, conversely, has thereon a ledge 20 which projects from the edge thereof that is pivotally supported on tub 3, and which is adapted to stop the rotation of the baffle 6 in the position of FIG. 1 by engagement with an abutment 8 on the evaporator 1.

The tub 3, adjacent its free end wall remote from shaft 4, has projecting from the bottom thereof a partition wall 15, the height of which is less than that of the perimetral walls of the tub 3, and which partition is parallel to said end wall. The distance between the partition wall 15 and the corresponding parallel wall is less than the minimum dimension of the cubes 14 which can be formed around the elements 2. From one end of the compartment formed between the wall 15, and the adjacent end wall of tub 3 emerges, an outlet 16, so that any water entering this chamber with discharged therefrom through outlet 16 into a drain manifold 17 equipped with a discharge pipe, 18 (FIG. 1).

The manifold 17 is arranged in one corner of a large reservoir 9, which is arranged beneath the tub 3 and equipped with heat-insulating walls 10.

The operation of the machine as described above is as follows.

By means of a cooling circuitry (not shown) the evaporator 1 enters action and acts upon the water, previously, introduced into the tub 3 up to a preselected level (FIG. 3), by means of the elements 2. The cooling action causes the formation of ice around the elements 2, until cubes or slugs 14 of the desired size are obtained. At this stage a reversal circuit (not shown) enters action and heats the elements 2 so as to start the unsticking of the cubes 14 therefrom. Concurrently, the member 5 enters action and unlatches the tub 3, the latter being thus tilted to the position shown in FIG. 1. Simultaneously, also the baffle 6 is spontaneously tilted with tub 3 and brought to the position of FIG. 1. The cubes 14 drop onto the planar section 7 of baffle 6, which deflects them directly into the reservoir 9. The unfrozen water, due to the tilting of the tub 3, overflows the partition wall 15, is collected by the corresponding compartment, and is forwarded through the outlet 16 into the manifold 17.

From the foregoing description it is apparent that the separation of the water is started as the tub is being tilted. This separation has not only a favourable bearing on the storage of the ice cubes, but also limits the heat dissipation : as a matter of fact, the cubes can rapidly be insulated without requiring any supplementary separation of water.

What I claim is:

1. In ice-making machine having a cooling circuitry connected to freezing elements immersed in a water-containing tub tiltable about a horizontal shaft, an actuating mechanism adapted to bring the tub from a horizontal position wherein the freezing elements are active to a tilted position wherein the cooling action is stopped after the formation of ice cubes or slugs around said elements, and a reservoir arranged beneath the tub, a device for deflecting ice cubes into said reservoir comprising an ice cube deflecting baffle arranged between the tub bottom and the freezing elements and adapted to deflect the ice over one end wall of said tub and towards the underlying reservoir, when said tub is in its tilted position, and a water manifold provided adjacent said one end wall of the tub for collecting and preventing water from said tub from entering said reservoir when said tub is in its tilted position.

2. A machine according to claim 1, characterized in that the manifold is a channel running along the inside of said one end wall and open at one end to communicate with a water collecting member provided within the reservoir beneath said tub.

3. A machine according to claim 1, characterized in that said manifold is formed by a partition wall formed in said tub in spaced, parallel relation to said one end wall, the distance of said partition wall from said one end wall being less than the minimum dimension of the cubes, and the height of being less than that of the other tub walls.

* * * * *